United States Patent [19]

Roelle

[11] 4,333,443

[45] Jun. 8, 1982

[54] COMPOUND BOW AND BOW CABLING SYSTEM

[75] Inventor: David Roelle, Pine Bluff, Ark.

[73] Assignee: Ben Pearson Archery Inc., Pine Bluff, Ark.

[21] Appl. No.: 196,470

[22] Filed: Oct. 14, 1980

[51] Int. Cl.[3] ..... F41B 5/00

[52] U.S. Cl. ..... 124/24 R; 242/155 R; 124/90; 24/201 A; 403/DIG. 4

[58] Field of Search ..... 124/23 R, 24 R, 25, 124/86, 88, 90, 80, DIG. 1; 24/201 A; 403/DIG. 4

[56] References Cited

U.S. PATENT DOCUMENTS

| | | | |
|---|---|---|---|
| 3,841,295 | 10/1974 | Hunter | 124/24 R |
| 4,054,118 | 10/1977 | McKee et al. | 124/90 X |
| 4,078,538 | 3/1978 | Shepley | 124/24 R |
| 4,241,715 | 12/1980 | Jennings | 124/24 R |

*Primary Examiner*—Richard C. Pinkham
*Assistant Examiner*—William R. Browne
*Attorney, Agent, or Firm*—Stephen D. Carver

[57] ABSTRACT

A compound bow, and a cabling system and eccentric for compound bows. Cable end terminals are adapted to be removably coupled together whereby to facilitate field disassembly. The bow has a pair of eccentric pulleys revolvably coupled at its opposite ends, over which a preferably segmented cable system is wound. The cable system preferably comprises a pair of pulley cables having a first end revolvably associated with a pulley and an opposite end adapted to be axially secured to the bow, a pair of string cables each having a first end revolvably associated with one of the pulleys and adapted to be selectively coupled to one of the pulley cable first ends and a second end terminating in a teardrop fitting, and a bow string extending between opposite bow limbs coupled to the teardrop fittings for propelling an arrow. Unique coupling members secured to ends of the pulley cables and the string cables enable them to be removably coupled together. Preferably the eccentric pulleys include a coupling receptive volume defined therein for confining and housing the coupling members. The coupling members, which are adapted to be disposed in abutting relation include channel portions for locking the cables together.

20 Claims, 5 Drawing Figures

COMPOUND BOW AND BOW CABLING SYSTEM

BACKGROUND OF THE INVENTION

This invention relates generally to compound bows. More particularly, the present invention is concerned with a compound bow having a user removable cable system, and a cable kit for compound bows.

In the past a variety of compound bows have been suggested. Essentially a compound bow includes a pair of eccentric members revolvably coupled to the bow at its limb ends. The eccentric members receive a portion of the bow string or cable, and as the archer pulls rearwardly on the bow string an overcenter action develops. Thus, the further back an arrow is pulled, the less force is required to maintain the bow in the "ready" position.

A variety of prior art approaches have been taken to removably couple the bow string to the bow. For example, the ends of a conventional bow may be notched appropriately to receive bow string loops at either end of the bow string. In compound bows teardrop fittings have been developed to removably couple the bow string to the operational ends of the pulley cabling system. Usually the cabling system includes portions which pass directly through the eccentric pulley and which are thus difficult to disassemble. Alternatively, cabling systems may be permanently secured to the pulley during bow manufacture, making field stripping of the bow by an archer practically impossible.

The eccentric pulleys utilized by compound bows revolve about an eccentric point other than the pulley center, so much pulley stress may be generated. Where segmented cables are joined by axially coupled ends, rather than being coupled to portions of the pulley, the pulley may be relieved of cable coupling stress. Consequently pulleys of lighter material and size and successfully employed. Furthermore, increased speed and ease of cable operation will be experienced when such unneccessary stresses are reduced.

SUMMARY OF THE INVENTION

The present invention comprises a compound bow equipped with a user removable cabling system, the ends of which are coupled together and preferably locked by special coupling fittings. The invention also comprises a quick disconnect cabling system kit for compound bows, and a unique eccentric pulley.

In a preferred form the bow comprises a rigid handle defined in central riser section to which outwardly extending limbs are coupled. The limbs terminate in end portions adapted to revolably receive a pair of eccentric pulleys, which pulleys may be mounted in a conventional fashion. The cabling system is adapted to revolvably associate with the pulleys for producing an overcenter action, and it includes a conventional bow string adapted to extend between the bow limb ends for propelling an arrow.

The cabling system is preferably segmented, including a separate pair of pulley cables and string cables. Each of the pulley cables includes a first end revolvably associated with one of the pulleys and a second end which is adapted to be axially secured to the bow, possibly being wound about one or more idler pulleys. The string cables each include a first end revolvably associated with one of the pulleys and a second end provided with a conventional teardrop fitting for attachment to the bow string. Coupling members are secured to the first ends of the pulley cables an the string cables for coupling same together. The coupling members preferably include a locking channel defined therein, for substantially surrounding at least a portion of the cable end terminating in an adjacent, juxtapositoned coupling. In a preferred form of the invention both the coupled coupling members may be housed within a special volume defined within the eccentric pulley for confining and housing the coupling members.

The cabling system conversion kit includes the above discussed cabling structure and associated eccentric pulleys. The pulleys themselves are also unique, including the previously mentioned coupling receptive housing.

Thus an object of this invention is to provide a compound bow which may be quickly disassembled by an archer.

A similar object of this invention is to provide a compound bow characterized by ease of cable disassembly.

Another object of this invention is to remove stress from eccentric members, such as eccentric pulleys, employed in compound bows.

A still further object of this invention is to provide a means whereby cable ends may be coupled together and housed in a special volume defined in a pulley.

Yet another object of this invention is to provide a removable cabling kit which is adapted to be installed on compound bows.

Another object of this invention is to provide a reliable system for removably joining the ends of a bow cabling system together.

A related object of this invention is to provide a cabling system for a compound bow which may quickly be replaced or repaired in the field by an archer.

A similar object of this invention is to provide a cabling system for a compound bow of the character described which is of a segmented construction.

These and other objects and advantages of this invention, along with features of novelty apurtenant thereto, will appear of become apparent in the course of the following description sections.

BRIEF DESCRIPTION OF THE DRAWING

In the appended drawings, which form a part of the specification and which are to be construed in conjunction therewith, and in which like reference numerals have been employed throughout to indicate like parts in the various views.

DETAILED DESCRIPTION OF THE DRAWINGS

Figures 1, 2:
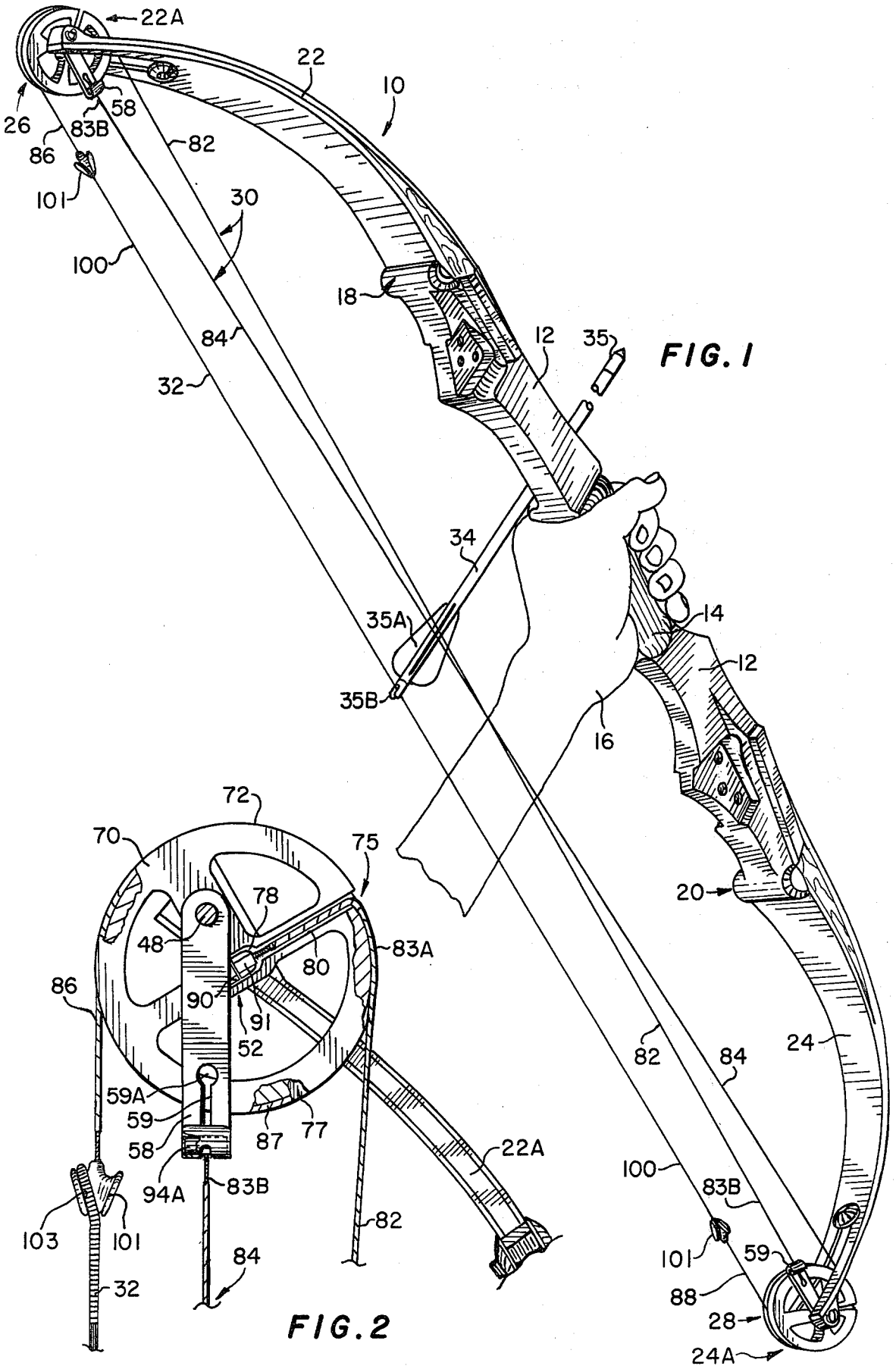
FIG. 1 is an isometric, pictorial view of a compound bow constructed in accordance with the teachings of this invention and illustrating the cable system.
FIG. 2 is an enlarged, plan view of the preferred eccentric pulley and cabling system employed by the present invention, with parts thereof broken away or shown in section for clarity.

With reference now to the drawings, a compound bow constructed in accordance with the teachings of this invention is generally indicated by the reference numeral 10. Bow 10 includes a conventional riser section 12 provided with a conventional intermediately positioned handle 14 which is adapted to be manually grasped by the hand 16 of the archer. Opposite ends 18, 20 of riser 12 are conventional coupled to outwardly extended bow limbs 22, 24. As will be best seen in FIG. 1, the opposite ends 18, 20 of riser 12 are drilled and tapped to receive conventional accessories such as stabilizers and other options.

Limbs 22, 24 terminate in limbs ends 22A, 24A respectively. A pair of eccentrics, generally indicated by the reference numerals 26, 28, are revolvably coupled to limb ends 22A, 24A respectively. A removable cabling system, generally indicated by the reference numeral 30 is revolvably associated with the eccentrics 26, 28, operationally extending between limbs 22A, 24A. A bow string 32 associated with cable assembly 30 extends between the pulleys 26, 28 for propelling a conventional arrow 34 from the bow 10. Arrow nock 35B conventionally contacts string 32.

Figure 3:
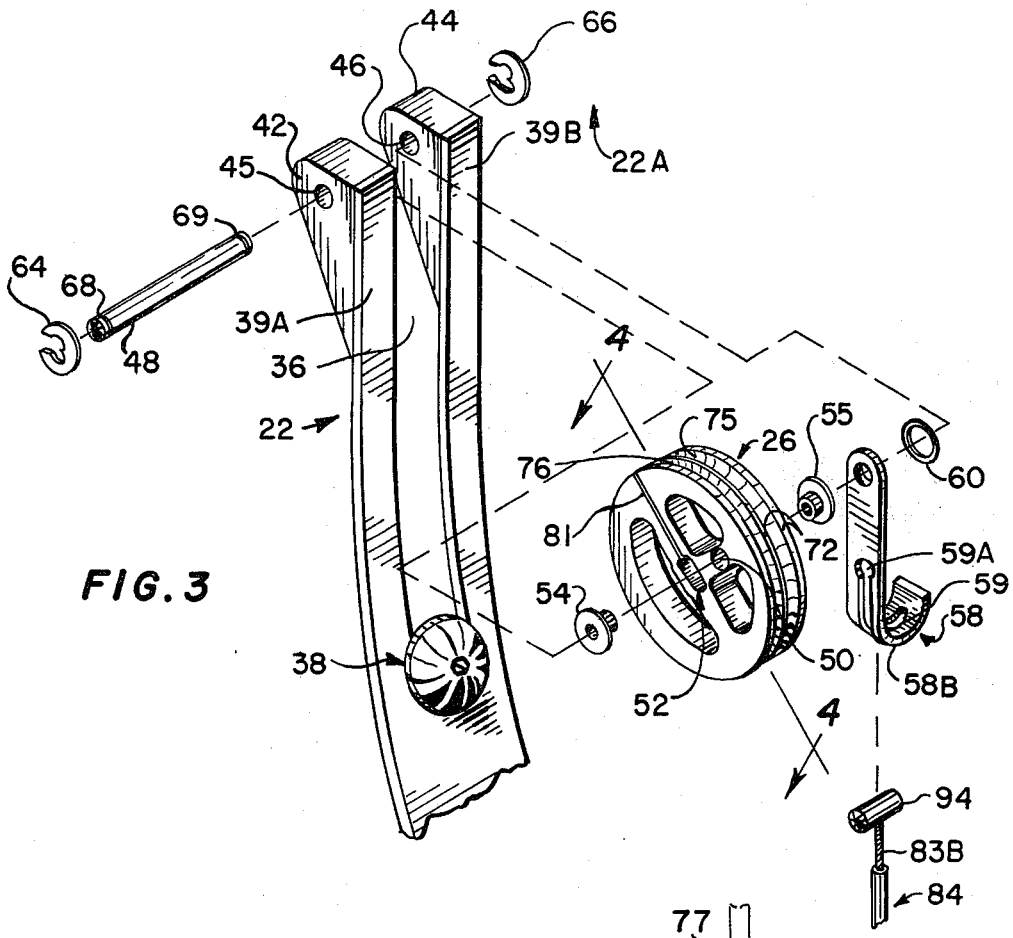
FIG. 3 is an enlarged, isometric, exploded view of a bow limb end illustrating the pulley assemblies, with parts thereof broken away or shown in section for clarity.

With particular reference now to FIG. 2 and 3, each of the bow limb end portions 22A, 24A are slotted to receive the eccentric pulley members 26, 28 respectively.

While in a preferred form of this invention the limb ends 22A, 24A are slotted, other pulley mounting techniques may be used. Thus limb end 22A (FIG. 3) includes an elongated end slot 36 which terminates in a limb reinforcement member 38. The tips 39A, 39B of limb end 22A are provided with mandrel structures 42, 44 provided with aligned orifices 45, 46 respectively for receiving an axle 48. Each pulley includes a mounting orifice 50 spaced apart from the center region 52 thereof which is adapted to be penetrated by axle 48. When the assembly is mounted within slot 36, a pair of flanged bearings 54, 55 will be inserted in opposite ends of orifice 50. Key hole disconnect fitting 58 an an associated spacer 60 are additionally confined between the pulley 26 and the mounting mandrels 42, 44. Once axle 48 is assembled through orifices 45, 46, 50, and 57 and bearings 54, 55 it is axially secured by snap fittings 64, 66 which are fitted to appropriate grooves 68, 69 defined in opposite ends of axle 48. It will thus be apparent that the pulley 26 is free to rotate about an offset center of rotation defined by orifice 50. The center of rotation is substantially spaced apart from the center region 52 of the pulley, whereby to facilitate the overcenter action characteristic of compound bows. Alternatively, an eccentrically shaped member may be revolvably coupled to the limb ends.

Figure 4:
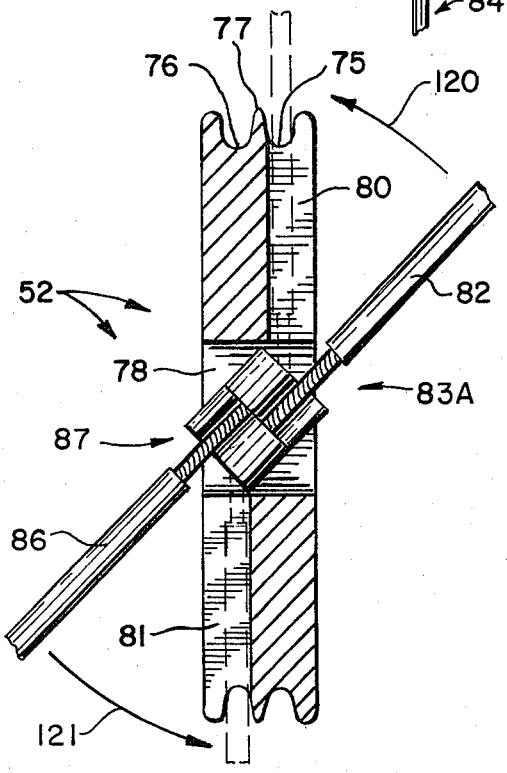
FIG. 4 is an enlarged, pictorial sectional view illustrating a preferred pulley, the coupling receptive area defined therewithin, and placement of a pair of cable ends to be joined; and, FIG. 5 is an isometric, pictorial view of the preferred cable end coupling members, illustrating how cable end portions are received through channel portions thereof.

With reference now to FIGS. 2 and 4, the eccentric pulley preferably employed by the instant invention includes a rigid, preferably metallic circular frame 70 having a circumferential periphery 72. A pair of parallel grooves 75, 76 are defined in the pulley periphery to appropriately track the cables as will later be described in more detail. Wall 77 separates grooves 75, 76. A coupling orifice 78 is preferably defined substantially at the center region 52 of the pulley. A first cable access passageway 80 extends along the side of the pulley from the pulley center to outer groove 75. A diametrically oppositely positioned cable access groove 81 (FIG. 3) extends on the opposite side of the pulley between the central orifice 78 and groove 76.

The cabling system 30 may terminate in only two ends, or preferably it may be segmented and include discrete components. Preferably, cabling system 30 comprises a pair of pulley cables 82, 84 and a pair of string cables 86, 88. Each pulley cable includes a first end 83A revolvably associated with a pulley (within groove 75) and a second end 83B which is adapted to be axially secured to the bow. Cable end 83A of pulley cable 82 terminates in a coupling member 91 which is preferably positioned within pulley housing 78, and which will be described in more detail later in conjunction with FIG. 5. The second, opposite end 83B of pulley cable 82 is preferably axially secured to the bow. For example, it is provided with a T-fitting 94 (FIG. 3) adapted to be secured to fitting 58. Fitting 58 includes an elongated slot 59 terminating in access orifice 59A through which member 94 may be twistably inserted. When member 94 is then twisted appropriately, cable end 83B will be secured within the hook portion 58B of the fitting. It will be appreciated that the second end portions of the pulley cables may first be passed around or through additional pulleys, such as pulley idlers and the like. Cable termination on bow structure may of course be accomplished with a variety of different structures. Thus the teachings of this invention are not limited to "two-wheel" compound bows, but may be successfully employed with other configurations such as the popular "four wheel" and "six wheel" designs. The latter designs may require longer pulley cables to facilitate their route about additional pulleys prior to their ultimate physical attachment to the bow.

The string cables 86, 88 include first ends 87 substantially revolvably wound about the pulley circumference, occupying grooves 76. As will be discussed in more detail later, this first end of the string cables terminates in a coupling 90 adapted to be coupled in a manner to be described to similar coupling 91. The second ends 100 of the string cables are fitted with conventional teardrop fittings 101, which are coupled to a looped end 103 of the conventional bow string 32 in a conventional fashion. Hence, the teardrop fittings 101 at opposite ends of the bow removably couple the bow string to the cabling assembly 30.

The first end portions of both the pulley cables are to be removably coupled to the first end portions of the string cables. Although a variety of different approaches could be used to couple these members together, structure most clearly indicated in FIGS. 4 and 5 is preferably employed.

Figure 5:
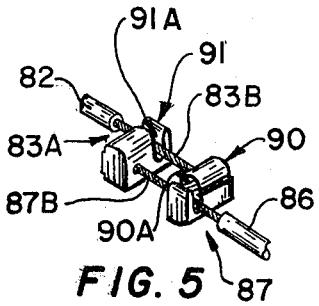

With reference particularly to FIG. 5, cable ends 83A, 87 preferably terminate in rigid, metallic coupling members 90, 91 respectively. Each coupling member 90, 91 is preferably generally cubical in geometry, and may be formed from metal or the like. Unsheathed cable end portions 83B, 87B are permanently secured within members 90 and 91. The members 90, 91 are adapted to be juxtapositioned in adjacent, abutting relation. Each coupling member preferably includes an integral channel portion adapted to substantially surround a portion of a cable end terminating in the adjacent coupling member. For example, coupling member 90 which is secured to cable 83B includes a channel portion 90A through which cable portion 87B extends. Similarly, cable end 83B extends through a channel 91A defined in adjacent coupling 91. As ends 83B, 87B are axially stressed, members 91, 90 will abut other, and locking will be achieved by the limiting effects of adjacent channels confining the cable end of the adjacent coupling member. In this manner a locking effect will be achieved.

It will be appreciated from FIG. 4 that when the cable coupling members are coupled together to secure cable ends they may be ideally positioned within the coupling receptive volume 78 preferably defined at the center 52 of the pulley. Volume 78 will be substantially shaped similarly to the shape of the coupled coupling members 90, 91 and should be secured in proper operative relationship manually after one of the cable ends has first been inserted through the pulley orifice 78, which extends between the sides of the pulley frame. After the members are suitably coupled together in the manner depicted, the coupled coupling members may be positoned within orifice 78 by rotating the assembly, for example as indicated by arrows 120, 121 in FIG. 4. It must be appreciated that at this time the cable ends will be appropriately positioned in the lateral, diametrically oppositely defined grooves 80, 81 which conduct the cable ends from the pulley center to the circumferential pulley grooves 75, 76. After the pulley cable pairs are appropriately joined in the respective pulley to the string cable pairs, the bow limbs may be manually tensioned to slacken the cable assembly whereupon bow string 32 may be coupled between teardrop fittings 101. Operation of the bow may then commence in the usual manner.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A compound bow comprising:

handle means adapted to be manually grasped by an archer;

a pair of resilient limbs extending outwardly from said handle, each limb terminating in limb end portions;

eccentric means revolvably coupled to each of said limb end portions;

cable means for propelling an arrow, said cable means including portions thereof wound about said eccentric means, said cable means terminating in ends fitted with individual coupling means for removeably securing said cable means ends together for quick disconnection and reconnection; and, coupling receptive means defined in said eccentric means for receiving and housing said coupling means at all times during operation of the bow, said receptive means being accessible exteriorly of said eccentric means to facilitate disassembly of said eccentric means and cable means in the field.

2. The combination as defined in claim 1 wherein said coupling means comprises first and second, rigid, cooperating members respectively permanently secured to said cable means ends to be joined and adapted to be juxtapositioned in adjacent, abutting relation when coupled together.

3. The combination as defined in claim 2 wherein said first and second cooperating coupling members each comprise channel portions adapted to substantially surround at least a portion of that cable end terminating in an adjacent coupling member, whereby to lock said coupling members together.

4. The combination as defined in claim 3 wherein said coupling receptive means comprises a volume defined within said eccentric means substantially shaped like a pair of coupled coupling means for confining said coupling members.

5. The combination as defined in claim 4 wherein said eccentric means comprises pulley means comprising:

a substantially flat, rigid circular frame having a center and outer circumference;

a pair of spaced apart cable receptive grooves defined in said outer circumference;

an eccentric pivot point defined in said frame and spaced-apart from said center; and, means defined in said frame for providing cable passage from said grooves to said coupling receptive volume.

6. The combination as defined in claim 5 wherein said cable receptive volume is located substantially at said pulley center.

7. A quick take-down compound bow comprising:

handle means adapted to be grasped by an archer;

a pair of resilient limbs extending outwardly from said handle, each limb terminating in limb end portions;

eccentric means revolvably coupled to each of said limb end portions;

cable means for propelling an arrow said cable means including portions thereof wound about said eccentric means and terminating in at least two ends; and, cable end couplings fitted to said cable ends for removably securing said ends together, said couplings comprising rigid cooperating members adapted to be juxtapositioned in adjacent, abutting relation when coupled together and including channel portions adapted to receive and substantially surround at least a portion of that cable end terminating in an adjacent coupling member whereby to lock said coupling members together.

8. The combination as defined in claim 7 wherein said eccentric means includes a coupling receptive volume defined therein substantially shaped like a pair of coupled coupling members for receiving and housing said coupling members whereby to secure said cable ends within said eccentric means.

9. The combination as defined in claim 8 wherein said eccentric means comprises pulley means comprising:

a substantially flat, rigid circular frame having a center and outer circumference;

a pair of spaced apart cable receptive grooves defined in said outer circumference;

an eccentric pivot point defined in said frame and spaced-apart from said center; and, means defined in said frame for providing cable passage from said grooves to said coupling receptive volume.

10. The combination as defined in claim 9 wherein said cable receptive volume is located substantially at said pulley center.

11. A compound bow adapted for quick disassembly, said bow comprising:

handle means adapted to be manually grasped by an archer;

first and second resilient limb means extending outwardly from said handle means terminating respectively in first and second limb end portions;

first and second eccentric pulley means revolvably coupled to said first and second limb end portions respectively;

a segmented cable system comprising:

a pair of pulley cables, each pulley cable having a first end revolvably associated with one of said pulley means at one of said limb end portions and a second end secured to said bow;

a bowstring adapted to extend between said first and second limb ends for propelling an arrow; and, a pair of string cables each having a first end revolvably associated with one of said pulley means at one of said limb end portions and coupled to one of said pulley cable first ends, each string cable including a second end removably coupled to said bowstring; and, coupling members secured to said pulley cable first ends and to said string cable first ends, said coupling members adapted to be selectively secured together whereby to connect a pulley cable to a string cable thereby joining said segmented cable system.

12. The combination as defined in claim 11 including coupling receptive means defined in each of said pulley means for receiving and housing said coupling members.

13. The combination as defined in claim 11 wherein said coupling members are adapted to be juxtapositioned in adjacent, abutting relation whereby to substantially axially connect cable ends secured together thereby.

14. The combination a defined in claim 13 wherein each coupling member includes a channel portion adapted to substantially surround at least a portion of that cable end terminating in an adjacent coupling member, whereby to lock said coupling members together.

15. The combination as defined in claim 13 including coupling receptive means defined in each of said pulley means for receiving said coupling members, said coupling receptive means comprising a volume defined within said eccentric means substantially shaped like a pair of coupled coupling members whereby to confine and hous said coupling members.

16. The combination as defined in claim 15 wherein each of said pulleys comprises:

a substantially flat, rigid circular frame having a center and an outer circumference;

a pair of spaced-apart, cable-receptive grooves defined in said outer circumference;

an eccentric pivot point defined in said frame and spaced apart from said center; and, channel means defined in said frame for providing cable passage from said grooves to said coupling receptive volume.

17. The combinations as defined in claim 16 wherein said cable receptive volume is located substantially at said pulley center.

18. An eccentric pulley adapted for use with compound bows equipped with cables fitted with end couplings, said pulley comprising:

a rigid circular frame having a center;

a point of rotation spaced apart from said center for revolvably coupling said pulley to ends of compound bow;

a coupling orifice in said pulley for releasably receiving and housing fittings which couple to cable ends together;

groove means defined in the outer periphery of the pulley for tracking said cables; and, access passagewy means for admitting a cable end into said coupling orifice.

19. The combination as defined in claim 18 wherein said coupling orifice is positioned substantially at said pulley center.

20. The combination as defined in claim 19 wherein said coupling orifice receives a pair of cable couplings.

* * * * *